United States Patent [19]

Sato et al.

[11] Patent Number: 5,044,290

[45] Date of Patent: Sep. 3, 1991

[54] WIPER UNIT OF A SEWING MACHINE

[75] Inventors: Shuichi Sato; Shirou Ayusawa, both of Utsunomiya, Japan

[73] Assignee: SSMC Inc., Edison, N.J.

[21] Appl. No.: 440,839

[22] Filed: Nov. 24, 1989

[30] Foreign Application Priority Data

Dec. 24, 1988 [JP] Japan ..... 63-166307[U]

[51] Int. Cl.[5] ..... D05B 65/00

[52] U.S. Cl. ..... 112/286

[58] Field of Search ..... 112/286, 242

[56] References Cited

U.S. PATENT DOCUMENTS 3,601,074 8/1971 Hagen ..... 112/286

3,847,102 11/1974 Rogner ..... 112/286

FOREIGN PATENT DOCUMENTS 5221929 6/1977 Japan ..... 112/286

*Primary Examiner*—Werner H. Schroeder

*Assistant Examiner*—Sullivan C. Prak

*Attorney, Agent, or Firm*—Theodore Jay

[57] ABSTRACT

A wiper unit has a supporter secured to the arm of a sewing machine. A stopper is secured to the supporter. A wiper shaft is rotatably supported by the supporter. The stopper restricts the rotation of the shaft. A wiper is mounted on the shaft. The wiper has a wiper arm and a tip end thereof. The tip end has a hook for wiping the tip end of an upper thread. A wiper operation crank is secured to the wiper shaft for adjusting a turning operation thereof relative to the wiper. An operation link is connected by a pin to the operation crank. A driving unit drives the operation crank reciprocally and drives the crank and shaft to turn about the axis of the shaft.

1 Claim, 8 Drawing Sheets

WIPER UNIT OF A SEWING MACHINE

BACKGROUND OF THE INVENTION

1. Field of the Invention

The present invention relates to a wiper unit of a sewing machine for wiping a thread end of a needle.

2. Description of the Prior Art

Wiper units are used with sewing machines provided with thread cutting units. The cutting unit cuts off a needle thread and a bobbin thread under a processed cloth after completion of a stitching operation of a piece of processed cloth. The wiper unit wipes the thread end of the needle thread and thereafter draws the thread end over the processed cloth and the cloth presser to thereby prevent the first stitching portion of the needle thread from being loosened on the processed cloth and causing quality deterioration.

There are two types of prior art wiper units. In the first type the thread end is wiped at a forward movement wherein the wiper moves from a return state at the lower position to a lifting state. (The first type is hereafter referred to as the forward movement wiping system.) In the second type, the thread end is wiped at a backward movement wherein the wiper moves from a return state at the upper position to the lower position, and turns to the lifting position. (The second type is hereafter referred to as the backward movement wiping system.) Depending on conditions and specifications of the stitching of the processed cloth, the forward movement wiping system or the backward movement wiping system is selected by an operator for integral use with the sewing machine.

In the forward movement wiping system, since the wiper is adjacent to the processed cloth at the normal state of the sewing machine in the lower position, the wiper depending on the shape, the kind, and the like of the processed cloth can obstruct the stitching operation. In such case, the backward movement wiping system is adopted since it does not create an obstruction because the wiping unit is positioned in the return state at the lifting position.

Since the wiping operation is effected at the backward movement while the needle thread end is retracted by a hooked portion of the wiper in the backward movement wiping system, erroneous wiping operation is liable to occur when the forward movement of the wiper unit ensues before the needle thread is properly positioned.

SUMMARY OF THE INVENTION

It is therefore an object of the present invention to provide a wiper unit of the sewing machine capable of switching a forward movement wiping system to a backward movement wiping system or vice versa with simple operations thus improving the quality of the sewing cloth.

To achieve this object, the wiper unit of the sewing machine according to the present invention employs an arm of the sewing machine. A support is secured to the arm. A wiper shaft is rotatably supported by the supporter. A wiper is mounted on the wiper shaft and has a hook portion at the tip end thereof for wiping a thread end of a needle thread. A wiper operation crank is secured to the wiper shaft to adjust a turning position thereof relative to the wiper. An operation link is connected to the wiper operation crank by a pin. A driving unit drives the operation link reciprocally and drives the wiper operation crank and the wiper shaft to turn about an axis of the wiper shaft.

The above and other objects, features and advantages of the present invention will become more apparent from the following description taken in conjunction with the accompanying drawings.

BRIEF DESCRIPTION OF THE DRAWINGS

FIG. 8(*b*) is a cross sectional view taken along VIII—VIII of FIG. 8(*a*);

DESCRIPTION OF THE PREFERRED EMBODIMENT

Figure 1:
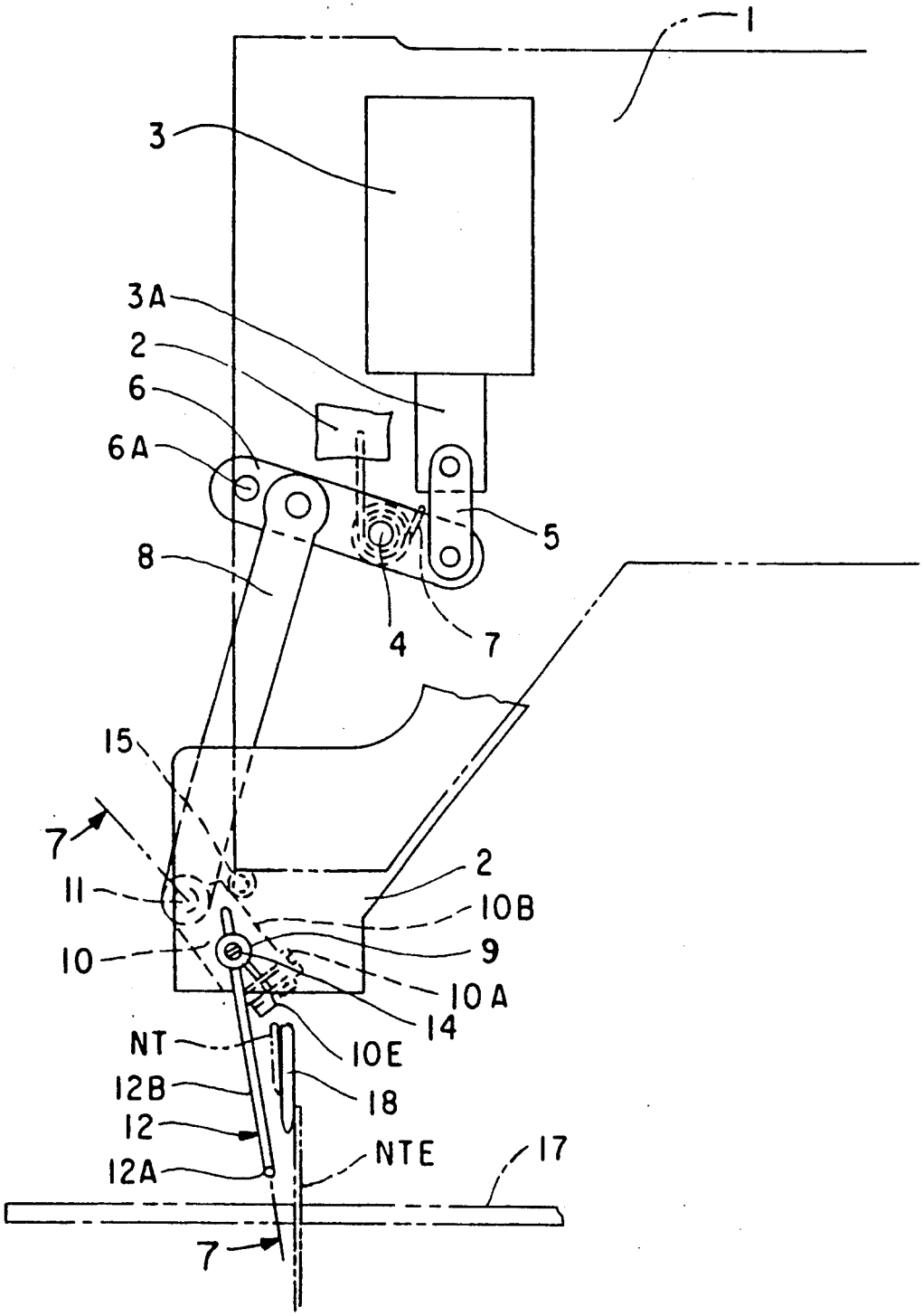
FIG. 1 is a view of a wiper unit employed in a forward movement wiping system.

The wiper unit of the sewing machine comprises an arm 1 of a sewing machine. A supporter 2 is secured to the arm 1. A wiper shaft 9 is rotatably supported by the supporter 2. A wiper 12 is mounted on the wiper shaft 9 and has a hook portion 12A at the tip end thereof for wiping a thread end of a needle thread NT. A wiper operation crank 10 is secured to the wiper shaft 9 for adjusting a turning position thereof relative to the wiper 12. An operation link 8 is connected to the wiper operation crank 10 by a pin 11. A driving unit 3 drives the operation link 8 reciprocally and drives the wiper operation crank 10 and the wiper unit shaft 9 to turn about an axis of the wiper shaft 9.

A forward movement wiping system of the preferred embodiment will be described more in detail hereinafter.

Figure 7:
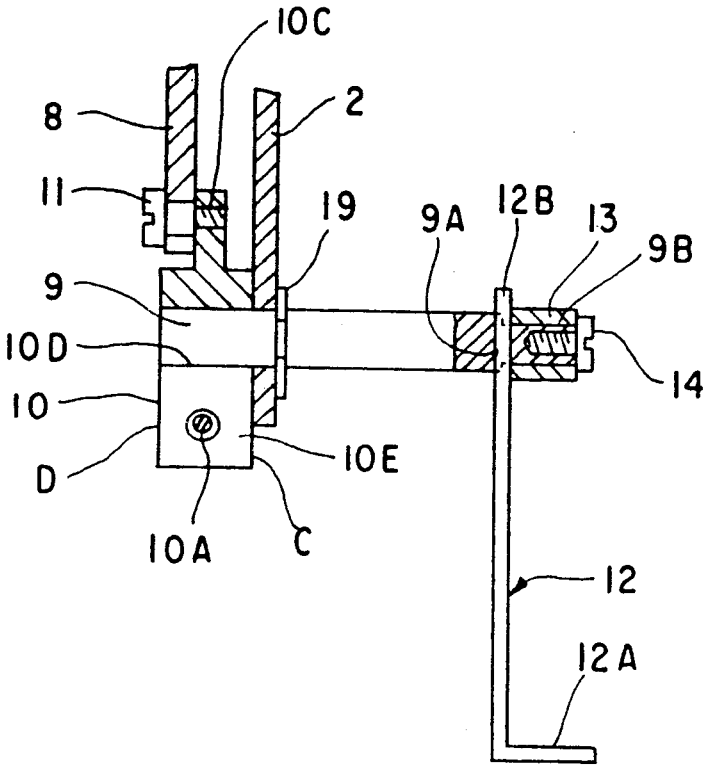
FIG. 7 is a cross sectional view taken along VII—VII of FIG. 1.
Figure 8A:
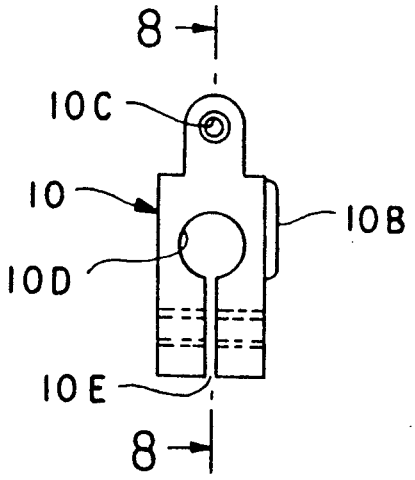
FIG. 8(*a*) is a view illustrating the operation of a wiper operating crank employed in the wiper unit of FIG. 1.
Figure 8B:
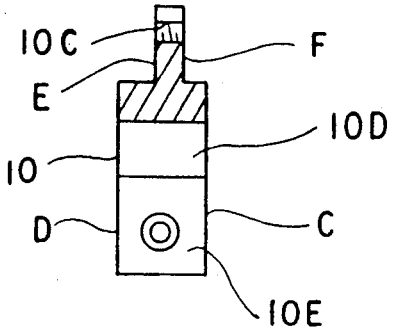

The supporter 2 secured to a rear surface of the chimney portion of the arm 1 of the sewing machine has a solenoid 3 which is retractably driven, or is vertically movable on reception of a signal issued from a controller (not shown). The solenoid 3 has at the end thereof a plunger having a tip end swingably connected to one end of a swing link 6 via the connection link 5 by a pin. The swing link 6 has a middle portion swingably supported on the supporter 2 by a shaft 4. The swing link 6 has the function of enlarging the movement of the connection link 5 to deliver the enlarged movement to the operation link 8 and is always urged by a spring 7 so that the plunger 3A is positioned at a return position when it is extended. The spring 7 is supported by the shaft 4 at the central portion thereof and has one end held by the swing link 6 and the other end held by the support member 2. The operation link 8 has one end which is connected to the other end of the swing link 6 by a pin and another end which extends substantially vertically and is connected to a tip end of the wiper operation crank 10. A screw hole 10C disposed at the tip end of the wiper operation crank 10 is laid over a small hole disposed at the other end of the operation link 8 and wherein both holes are screwed together by a hinged screw 11. A small hole 6A is disposed in the tip end of the swing ling 6. The position at which the swing crank 6 and the one end of the operation crank 8 are connected can be changed by connecting the two cranks together at hole 6A whereby the amount of turning of the wiper operation crank 10 can be adjusted. The wiper operation crank 10 has a tip portion extending in the left and upward direction and has a base portion with a hole 10D through which the wiper shaft 9 supported rotatably on the supporter 2 about the axis thereof is inserted. A slit 10E provided at the portion adjacent to the wiper operation crank 10 is fastened by a bolt 10A and is secured to the wiper shaft 9 by the friction force generated by the fastening of the bolt 10A. The wiper shaft 9 is prevented from slipping out of the slit 10E. The wiper operation crank 10 and the wiper shaft 9 can be secured at an arbitrary position after the bolt 10A is loosened to rotate both the wiper operation crank 10 and the wiper shaft 9. The wiper operation crank 10 is symmetrically positioned so that any of side surfaces C and D respectively at the lower portion of the wiper operation crank 10 can be positioned at and secured to the supporter 2 and any surfaces E and F respectively at the upper portion of the wiper operation crank 10 can be positioned at and secured to the operation link 8. In the forward wiping system as illustrated in FIG. 7, the side surface C is brought into contact with the supporter 2 while the side surface E is brought into contact with the operation link 8.

When the operation link 8 is moved downwardly then longitudinally from the return state in FIG. 1, the wiper operation crank 10 is rotatably driven counterclockwise about the axial line of the wiper shaft 9. The wiper 12 is substantially L-shaped and fixed to the wiper shaft 9 as shown in detail in FIG. 7. The wiper 12 has a base portion provided with an arm 12B fixed to the wiper shaft 9, a middle portion extending from the arm 12B, and a tip portion provided with a hook portion extending from the middle portion and bent in parallel with the axis of the wiper shaft 9 for catching a needle thread end NTE of the needle thread NT. The arm 12B can be detachably fixed to the wiper shaft 9 in the manner that the base portion of the arm 12B is inserted into the hole 9A at the small diameter portion 9B of the wiper shaft 9 and is pressed by a spacer 13 in the manner that the spacer 13 is mounted on the outer periphery of the small diameter portion 9B and a tie screw 14 is screwed into a screw hole defined in the tip end of the small diameter portion 9B to thereby press the spacer 13 toward the arm 12B. A stopper 15 projecting from the support 2 can move into contact with a side surface 10B of the wiper operation crank 10 to restrict the movement of the wiper shaft 9 to the return position.

A processed cloth 17 on the bed of the sewing machine is stitched by the needle thread NT threaded into the needle hole of a needle vertically movable within the arm 1 and a bobbin thread (not shown).

An operation of the forward movement wiping system will be described hereinafter.

Immediately before the wiper unit is operated, the wiper 12 is positioned in the return state as shown in FIG. 1 where the hook portion 12A of the wiper 12 is positioned at the lower position. After completion of a series of stitching operations on a piece of processed cloth, an operator depresses a foot pedal of the sewing machine (not shown) to permit a cutting unit (not shown) of the sewing machine to operate whereby the needle thread NT and the bobbin thread are cut off under the process cloth 17. The needle 18 is positioned adjacent to the top dead center while the thread end NTE of the needle thread NT is directed toward the processed cloth 17 from the needle 18 and extends substantially perpendicularly along the vertically movable passage of the needle 18.

Figure 2:
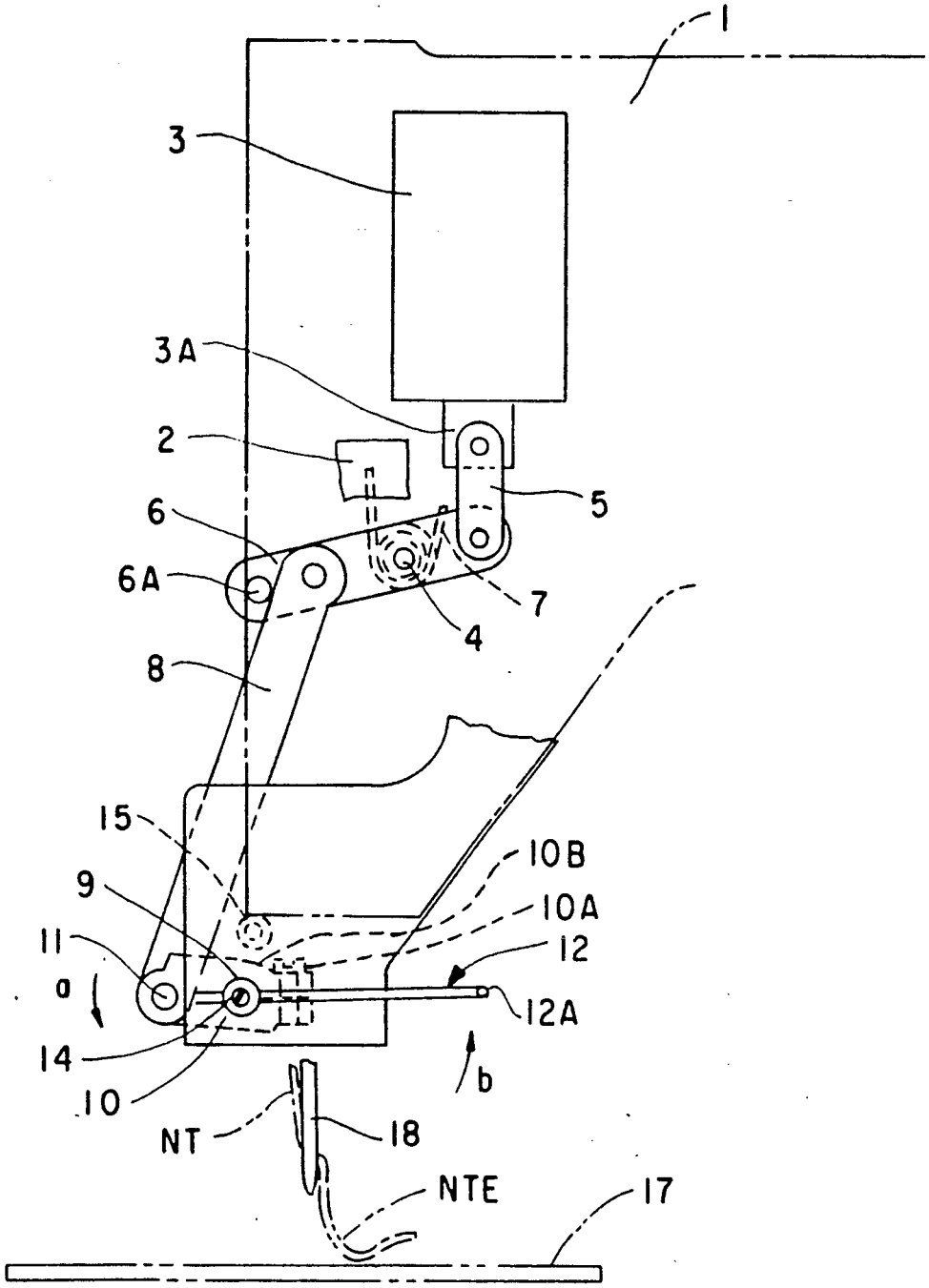
FIGS. 2 and 3 are views illustrating different operations of the wiper unit shown in FIG. 1.
Figure 3:
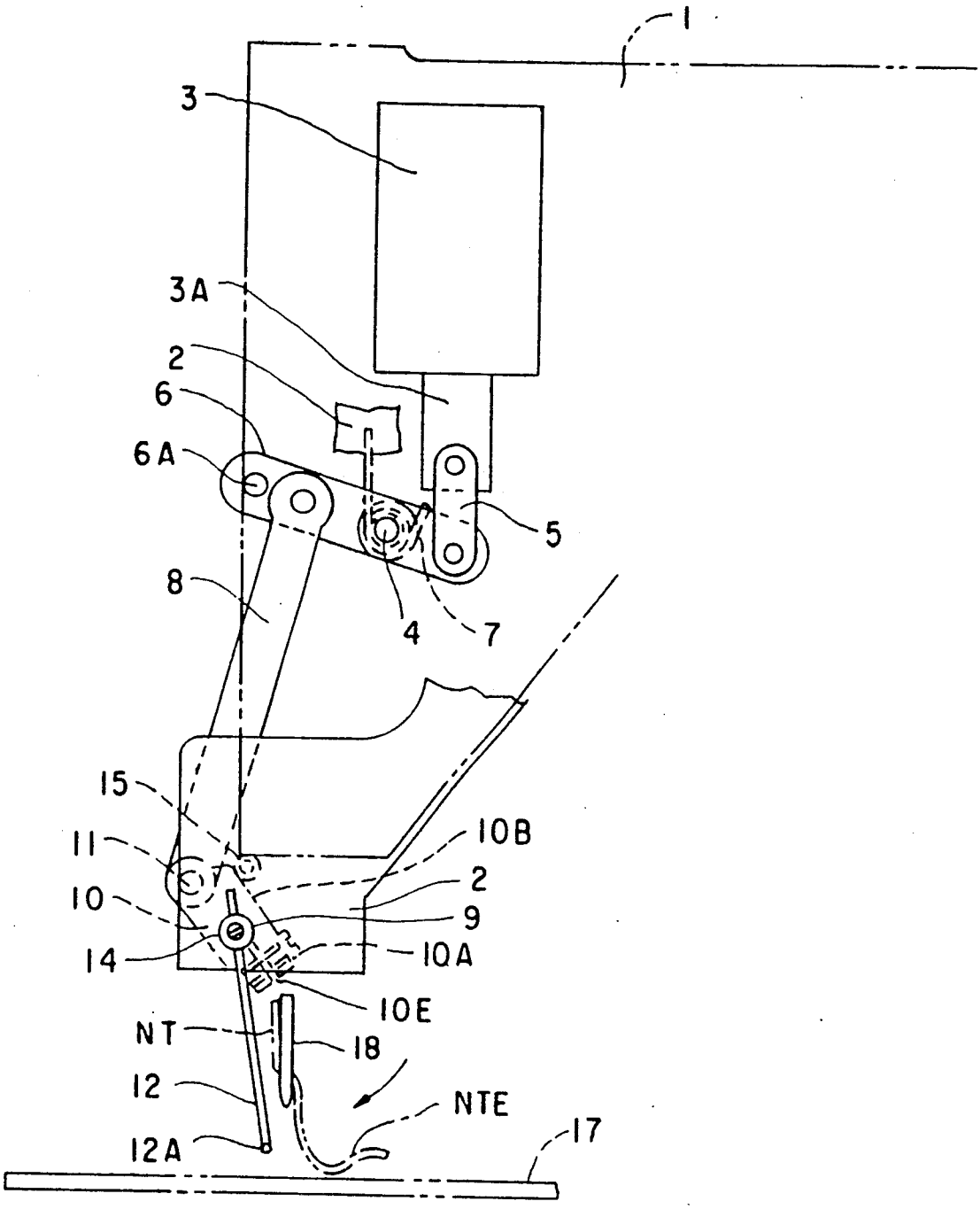

When the solenoid 3 receives an electric signal from the control unit, the plunger 3A moves downward against the resilient force of the coil spring 7 as shown in FIG. 2 so that the swing link 6 is swung about the shaft 4 via the connection link 5 to push the operation link 8 upward and thereby turn the wiper operation crank 10 together with the wiper shaft 9 in the direction of the arrow a. As a result, the wiper 12 fixed to the wiper shaft 9 is turned in the direction of the arrow b. With the forward movement of the wiper 12, the hook portion 12A of the wiper passes under the needle 18 positioned adjacent to the top dead center and wipes the thread end NTE of the needle thread NT extending substantially perpendicularly along the vertical movement passage of the needle 18, then swings to its maximum position, namely reaches the upper position whereby the thread end NTE is drawn from the processed cloth 17 so as to be positioned over a cloth presser (not shown).

When the control unit stops supplying the electric signal to the solenoid 3, the plunger 3A immediately returns to its return state thereby turning the wiper operation crank 10 and the wiper shaft 9 counterclockwise via the connection link, the swing link 6, and the operation link 8 whereby the wiper 12 is moved backward and the wiper operation crank 12 is returned to the original position with the side surface 10B of the wiper operation crank 10 being brought into contact with the stopper 15.

Switching operation from the forward movement wiping system to the backward movement wiping system will be carried out in the following way.

Firstly, the hinge screw 11 is removed to detach the wiper operation crank 10 from the operation link 8, then the screw 10A is loosened to extract the wiper shaft 9 from the wiper operation crank 10 and to reverse the wiper operation crank 10. Thereafter, the side surface 10D is positioned at the side of supporter 2 and the screw 10A is tightened. Then the wiper operation crank 10 is positioned to be inclined rightward and upward, and thereafter the operation link 8 and the wiper operation crank 10 are connected with each other by the hinge screw 11.

Figure 4:
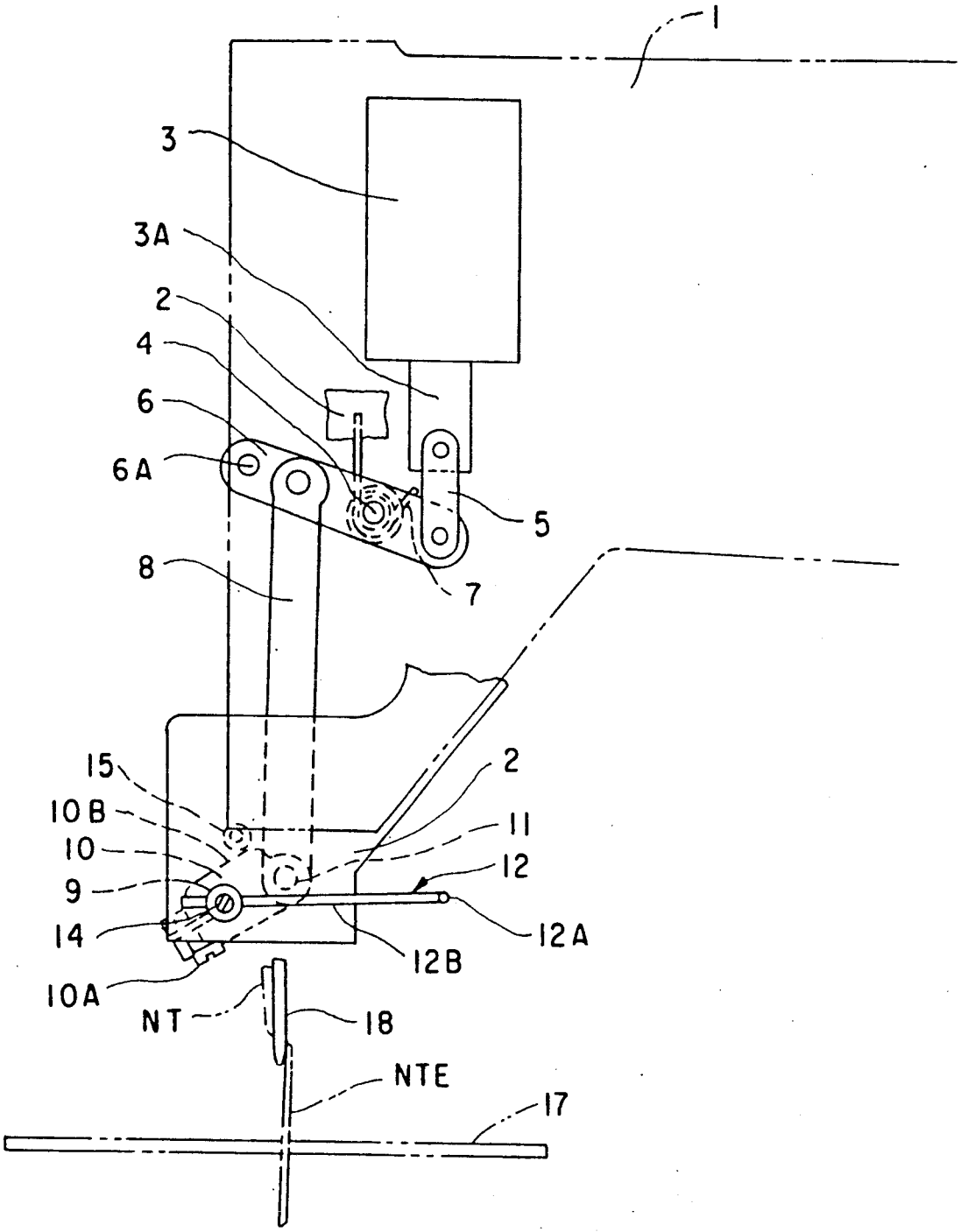
FIG. 4 is a view of a wiper unit employed in a backward movement wiping system.

Secondly, when the wiper 12 is returned and positioned at the lifting position and the side surface 10B of the wiper operation crank 10 is brought into contact with the stopper 15, the wiper shaft 9 is turned and adjusted relative to the wiper operation crank 10 so that the arm 12B can be substantially positioned in parallel. The screw 10A is then tightened to further fix the wiper shaft 9 to the wiper operation crank 10. As a result, the forward movement wiping system is changed to the backward movement wiping system as shown in FIG. 4. The switching operation from the backward movement wiping system to the forward movement wiping system can be carried out by reversing the steps described above.

Figure 5:
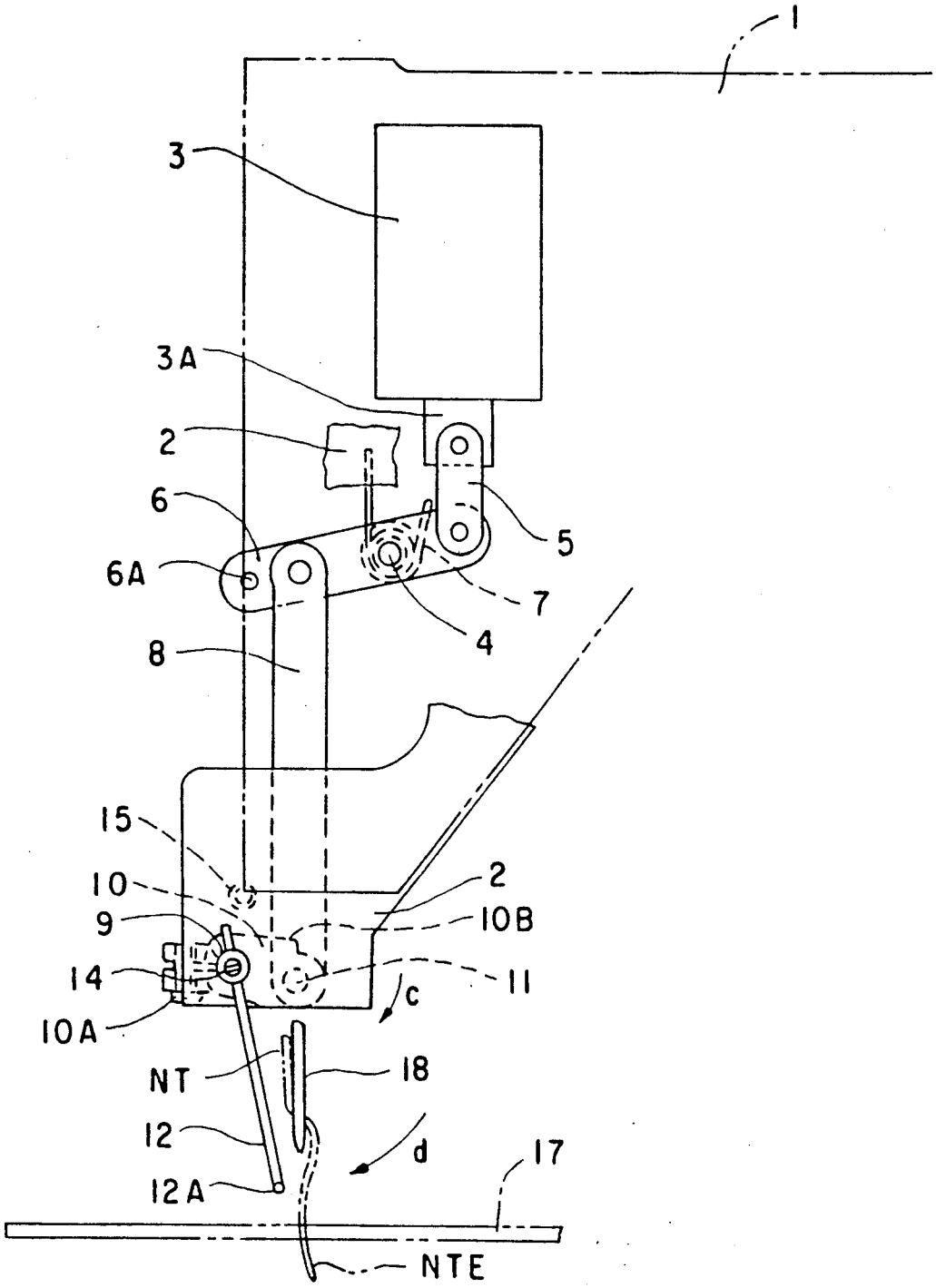
FIGS. 5 and 6 are views illustrating different operations of the wiper unit shown in FIG. 4.

An operation of the backward movement wiping system is hereinafter described with reference to FIGS. 4 to 6.

Figure 10:
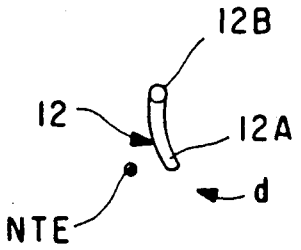
FIG. 10 is a view of the hook portion of the wiper employed in the wiper unit of FIG. 1.

As shown in FIG. 4, the wiper signal unit is operated, the wiper 12 is normally substantially horizontally positioned in the upper position with the hook portion 12A being positioned in the uppermost position. At this state, when the control unit supplied the electric signal to the solenoid to permit the plunger 3A to move upward against the resilience force of the coil spring 7, the swing link 6 is swung about the shaft 4 via the connection link 5 to push the operation link 8 upward in the figure so that the wiper operation crank 10 is turned together with the upper shaft 9 in the direction of the arrow c, whereby the wiper 12 is turned together with the wiper shaft 9 in the direction of the arrow d. With the forward movement of the wiper 12, the hook portion 12A of the wiper 12 passes under the needle 18 positioned adjacent to the top dead center and reaches the maximum swing position. At that time, although the hook portion 12A contacts the thread end NTE, the wiper 12 can not wipe the thread end NTE while the thread end NTE is kept caught by the hook portion 12A in the backward movement of the wiper 12. Hence, the hook portion 12A is curved in the circular arc as shown in FIG. 10 so that the convexed circular surface of the hook portion 12A contacts the thread end NTE in the forward movement to push away the thread end NTE while the concaved circular surface of the hook portion 12A contacts the thread end NTE in the backward movement to surely catch the thread end NTE.

Figure 6:
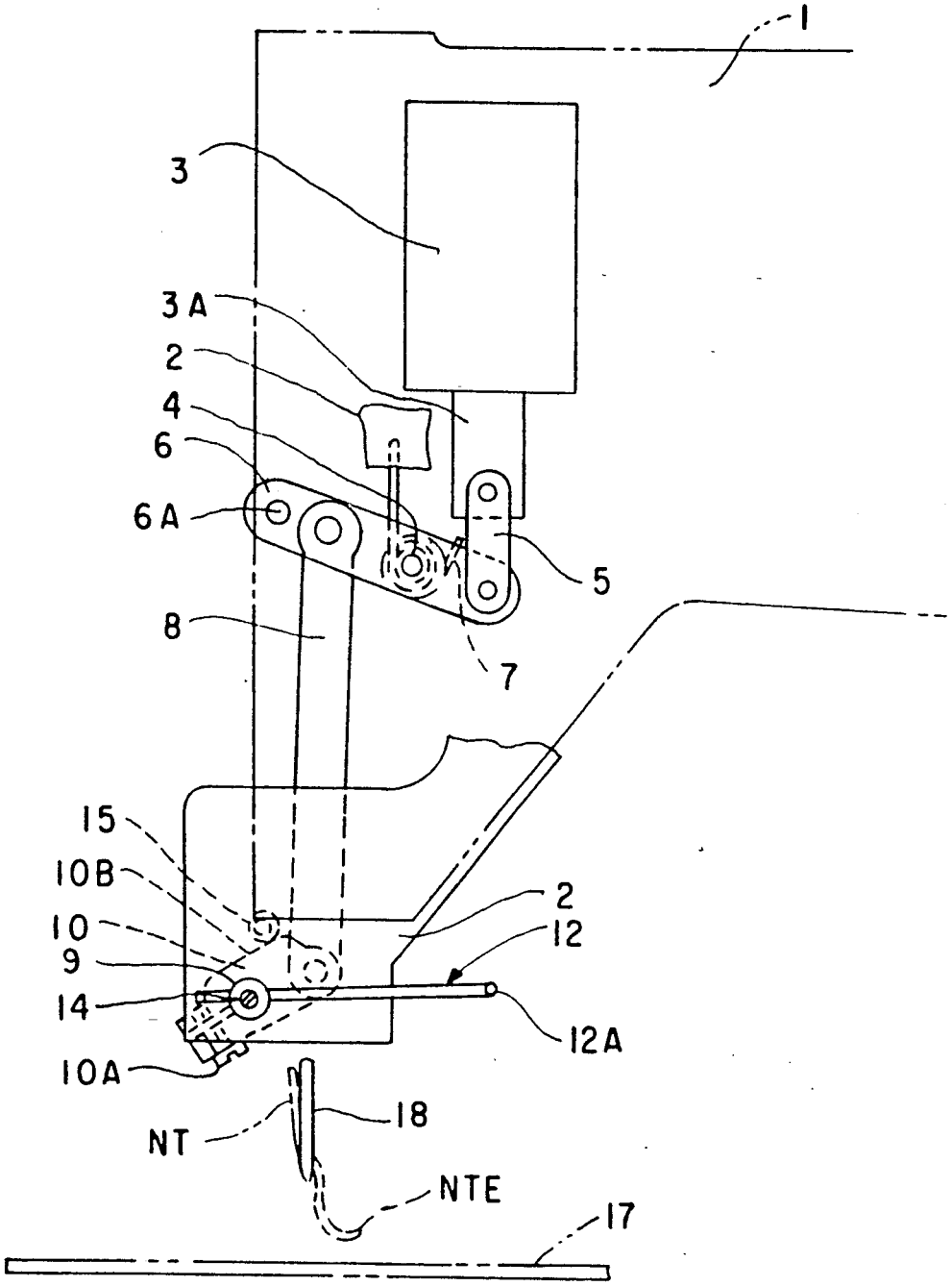

When the control unit stops supplying the electric signal to the plunger 3A, this permits the plunger 3A to project and immediately move forward (as shown in FIG. 6) to turn the wiper operation crank 10 and the wiper shaft 9 counterclockwise via the connection link 5, the swing link 6 and the operation link 8, whereby the side surface 10B of the wiper operation crank 10 is brought into contact with the stopper 15 so that the wiper 12 returns to its original position. At this time, the thread end NTE of the needle thread NT extending substantially perpendicularly along the vertical movement passage of the needle 18 is wiped by the hook portion 12A and extracted from the processed cloth and drawn over the upper side of the cloth presser (not shown).

SECOND EMBODIMENT (FIG. 9)

Figure 9:
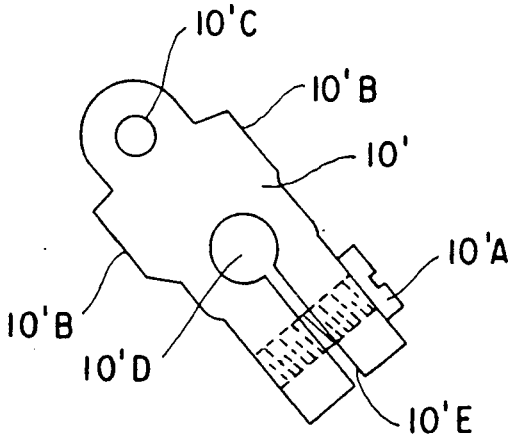
FIG. 9 is a view illustrating the operation of another embodiment of a wiper operating crank.

With the arrangement of the first embodiment as set forth above, inasmuch as only the side surface 10B of the wiper operation crank is brought into contact with the stopper 15 at the time of return thereof, the wiper operation crank 10 is reversed at the switching operation between the forward movement wiping system and the backward movement wiping system. However, the switching operation between them is more easily carried out by the arrangement wherein the wiper operation crank 10' is shaped as that illustrated in FIG. 9, namely in the manner that the side surfaces 10' are positioned symmetrically. In the latter arrangement, the hinge screw 10'B is removed and the screw 10'A is loosened, then the wiper operation crank 10' is turned 270 degrees in the direction which does not hinder the stopper 15 permitting the wiper 12 to be appropriately positioned and thereafter the operation link 8 is connected to the wiper operation crank 10'.

With the arrangements of the first and the second embodiments, inasmuch as the wiper unit of the sewing machine is capable of effecting the switching operation between the forward movement wiping system and the backward movement wiping system with ease, an appropriate wiping system can be selected in conformity with the processed cloth so that the quality of the stitched processed cloth is improved.

Although the invention has been described in its preferred form with a certain degree of particularity, it is to be understood that many variations and changes are possible in the invention without departing from the scope thereof.

What is claimed is:

1. A wiper unit for sewing machine having an arm and comprising:

a supporter secured to the arm of the sewing machine;

a stopper secured to the supporter;

a wiper shaft rotatably supported by the supporter, the stopper restricting the rotation of the shaft;

a wiper mounted on the wiper shaft, the wiper having a wiper arm and a tip end thereof, the tip end having a hook for wiping a thread end of an upper thread;

a wiper operation crank fixed to the wiper shaft for adjusting a turning position thereof relative to the wiper;

an operation link;

a pin connecting the operation link to the operation crank; and a driving unit for driving the operation link reciprocally and for driving the wiper operation crank and the wiper shaft to turn about an axis of the wiper shaft.

* * * * *